US009902526B2

(12) United States Patent
Hall

(10) Patent No.: US 9,902,526 B2
(45) Date of Patent: Feb. 27, 2018

(54) STORAGE ASSEMBLY

(71) Applicant: Erma Hall, Chesapeake, VA (US)

(72) Inventor: Erma Hall, Chesapeake, VA (US)

( * ) Notice: Subject to any disclaimer, the term of this patent is extended or adjusted under 35 U.S.C. 154(b) by 45 days.

(21) Appl. No.: 15/137,244

(22) Filed: Apr. 25, 2016

(65) Prior Publication Data

US 2017/0305601 A1 Oct. 26, 2017

(51) Int. Cl.

| | |
|---|---|
| ***B65D 85/00*** | (2006.01) |
| ***B65D 25/20*** | (2006.01) |
| ***B65D 1/40*** | (2006.01) |
| ***B65D 25/04*** | (2006.01) |
| ***B65D 25/28*** | (2006.01) |
| ***B65D 51/00*** | (2006.01) |

(52) U.S. Cl.

CPC ..... *B65D 25/205* (2013.01); *B65D 1/40* (2013.01); *B65D 25/04* (2013.01); *B65D 25/2802* (2013.01); *B65D 51/00* (2013.01)

(58) Field of Classification Search

CPC ..... B65D 25/20; B65D 25/205; B65D 25/22; B65D 25/24; B65D 25/28; B65D 25/2823; B65D 25/2802

USPC ..... 206/459.5

See application file for complete search history.

(56) References Cited

U.S. PATENT DOCUMENTS

| | | | | |
|---|---|---|---|---|
| 1,977,092 | A | 8/1931 | Scurlock | |
| 2,110,921 | A * | 3/1938 | Scurlock | A47G 19/32 131/241 |
| 2,281,849 | A | 5/1942 | McCoppin | |
| D407,610 | S | 4/1999 | Weterrings et al. | |
| D464,533 | S | 10/2002 | McGuyer | |
| 6,957,739 | B1 | 10/2005 | Stephenson | |
| 7,156,226 | B1 | 1/2007 | Van Sickle | |
| 8,302,787 | B2 * | 11/2012 | Tobey | A61J 1/16 211/77 |
| 8,915,391 | B2 * | 12/2014 | Radow | A47G 19/00 108/139 |

* cited by examiner

*Primary Examiner* — Steven A. Reynolds
*Assistant Examiner* — Javier A Pagan

(57) ABSTRACT

A storage assembly includes a first disk that may be positioned on a support surface. A storage array is provided and the storage array may contain a plurality of objects. The storage array has a plurality of bins and the objects may be positioned in the bins. The storage array is rotatably positioned on the first disk. A cover is removably coupled to the storage array. A handle is removably coupled to the storage array and the handle be manipulated thereby facilitating the storage array to be carried.

10 Claims, 4 Drawing Sheets

STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing and organizing crayons according to color.

BRIEF SUMMARY OF THE INVENTION

An embodiment of the disclosure meets the needs presented above by generally comprising a first disk that may be positioned on a support surface. A storage array is provided and the storage array may contain a plurality of objects. The storage array has a plurality of bins and the objects may be positioned in the bins. The storage array is rotatably positioned on the first disk. A cover is removably coupled to the storage array. A handle is removably coupled to the storage array and the handle be manipulated thereby facilitating the storage array to be carried.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
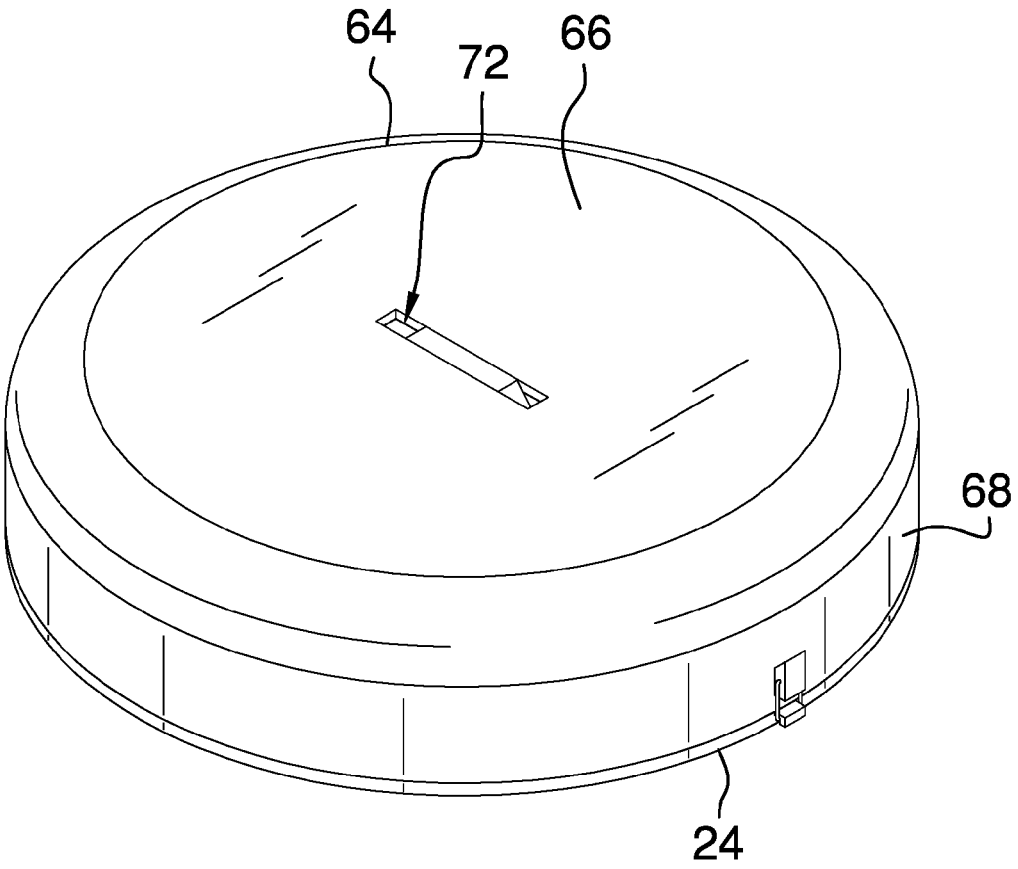
FIG. 1 is a top perspective view of a storage assembly according to an embodiment of the disclosure.
Figure 2:
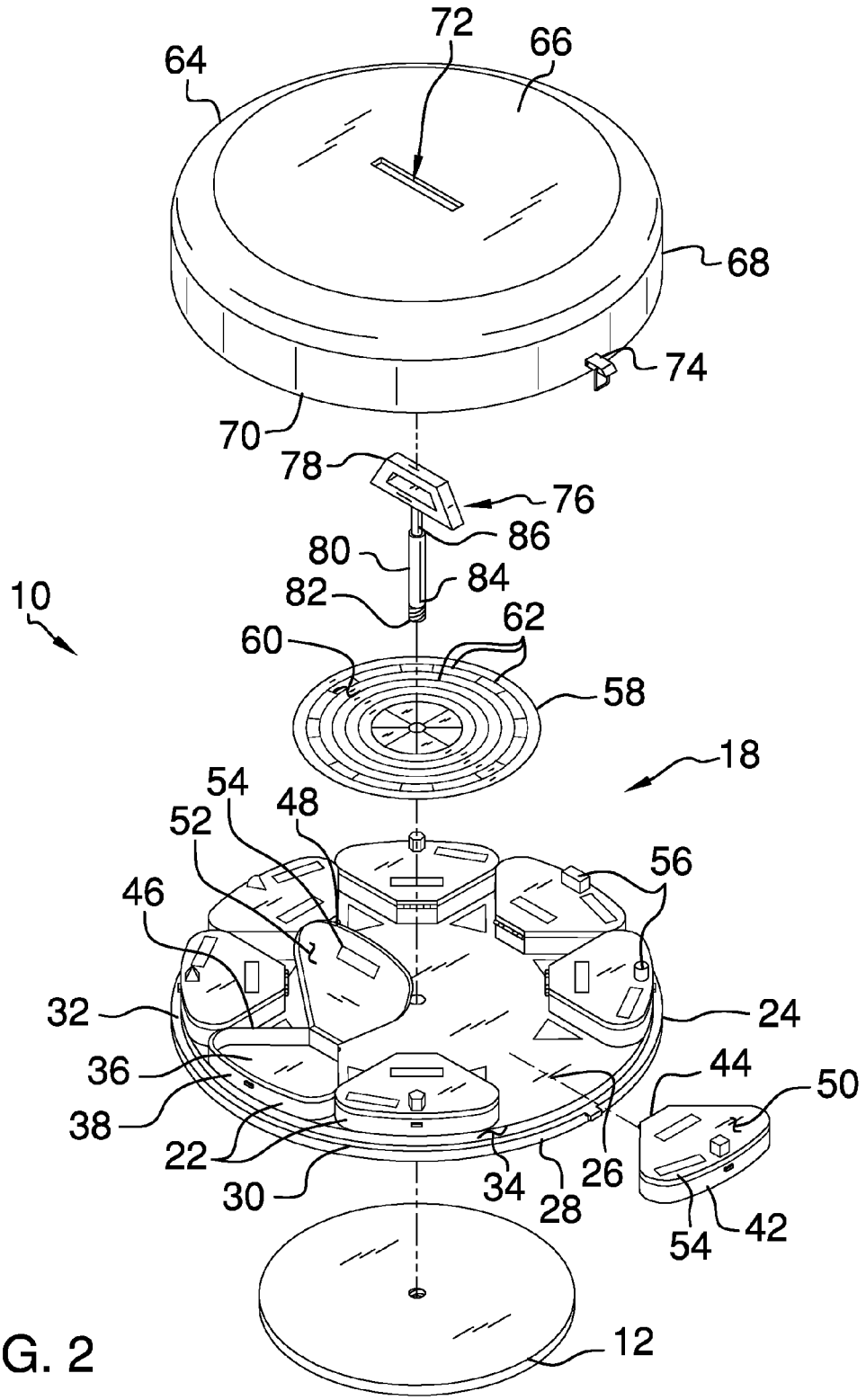
FIG. 2 is an exploded perspective view of an embodiment of the disclosure.
Figure 3:
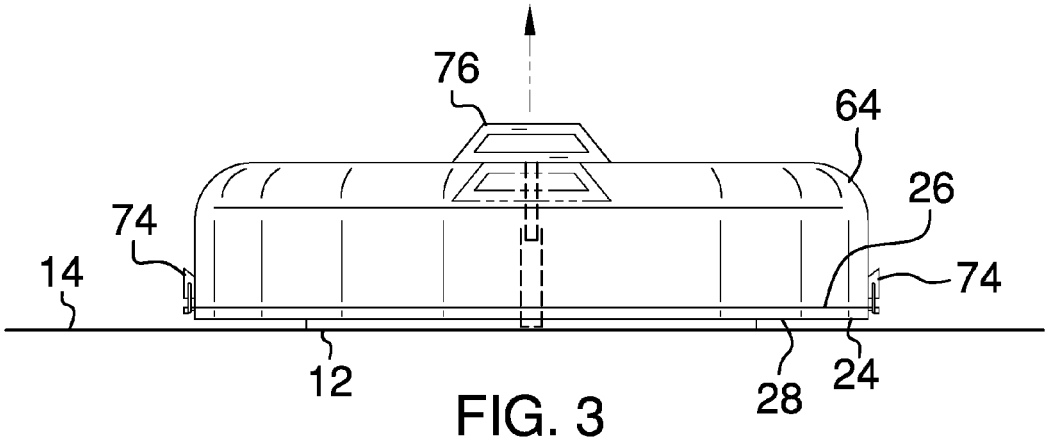
FIG. 3 is a right side view of an embodiment of the disclosure.
Figure 4:
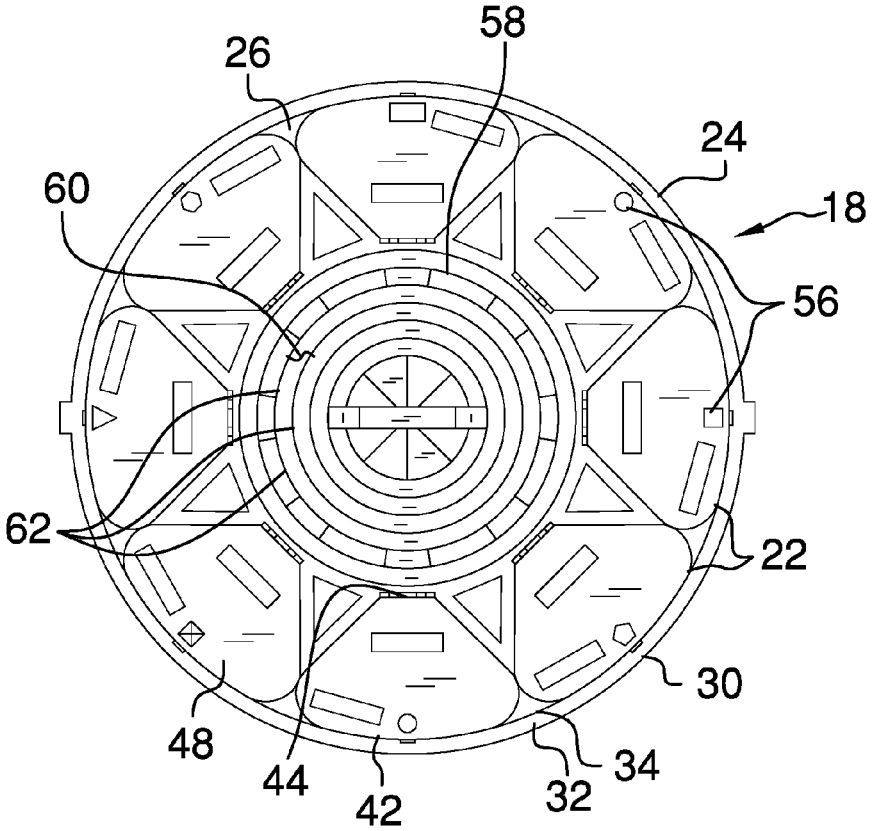
FIG. 4 is a top view of a storage array of an embodiment of the disclosure in a closed position.
Figure 5:
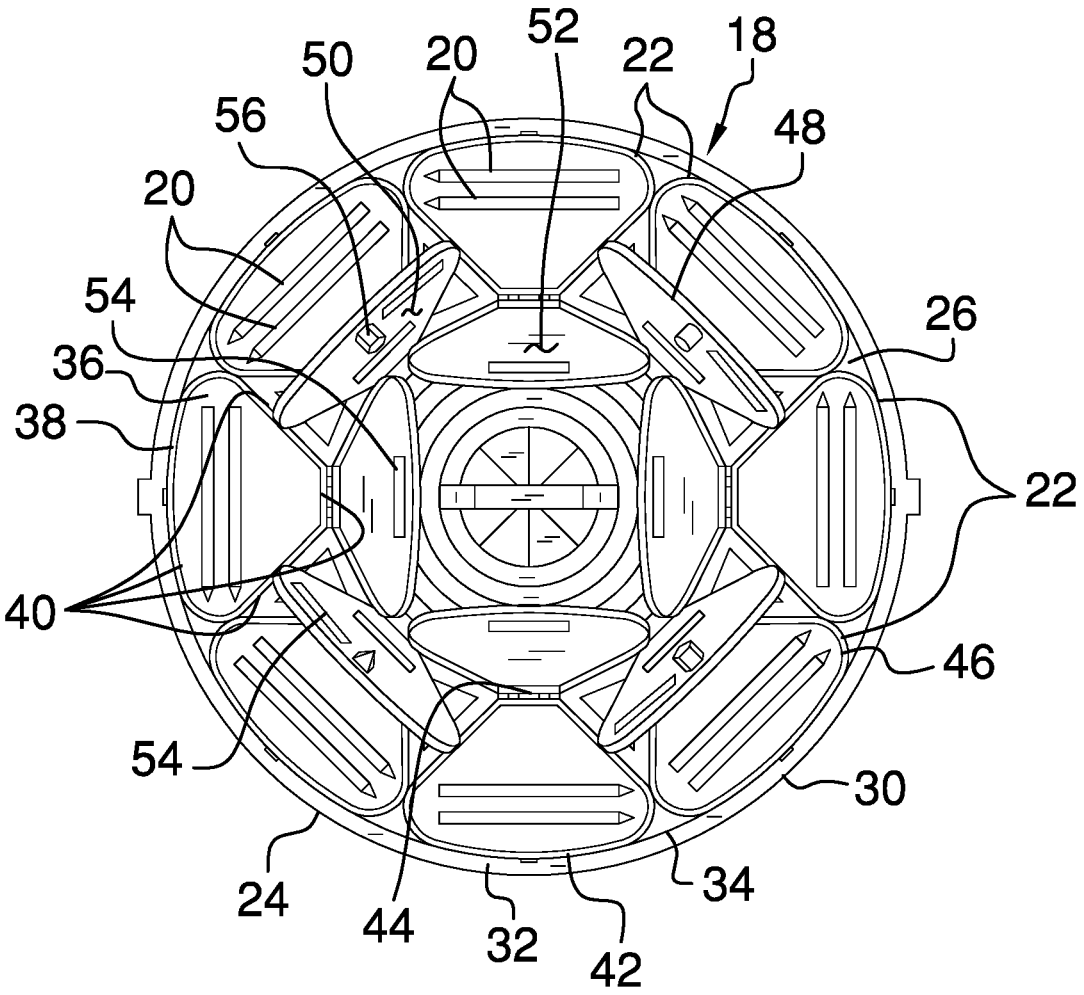
FIG. 5 is a top view of a storage array of an embodiment of the disclosure in an open position.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the storage assembly 10 generally comprises a first disk 12 that may be positioned on a support surface 14 and the first disk 12 has a top side 16. The support surface 14 may be a table or the like. A storage array 18 is provided and the storage array 18 may contain a plurality of objects 20. The storage array 18 has a plurality of bins 22 and each of the bins 22 may have the objects 20 positioned therein. The storage array 18 is rotatably positioned on the first disk 12. The objects 20 may be crayons or the like.

The storage array 18 comprises a second disk 24 that has an upper side 26, a lower side 28 and a peripheral edge 30 extending therebetween. The upper side 26 is recessed along the peripheral edge 30 to define a ledge 32 on the second disk 24. The ledge 32 has a bounding surface 34. The second disk 24 is rotatably positioned on the first disk 12 having the lower side 28 abutting the top side 16.

Each of the bins 22 comprises a bottom wall 36 and an exterior wall 38 extending upwardly from the bottom wall 36. The exterior wall 38 has a plurality of intersecting sides 40 such that each of the bins 22 has a trapezoidal shape. The plurality of intersecting sides 40 includes a first side 42 being spaced from a second side 44. The exterior wall 38 has a distal edge 46 with respect to the bottom wall 36.

Each of the bins 22 is removably positioned on the second disk 24 having the bottom wall 36 abutting the upper side 26. The bins 22 are arranged to define a ring extending around the second disk 24. The first side 30 of each bin 22 is aligned with the bounding surface 34 of the ledge 32. Moreover, the exterior wall 26 corresponding to each bin 22 is comprised of a translucent material. Thus, the objects 20 are visible through the exterior wall 26 when the objects 20 are contained in the bins 22.

Each of the bins 22 includes a lid 48. The lid 48 is hingedly coupled to the distal edge 46 corresponding to the second side 44. The lid 48 has a top surface 50 and a bottom surface 52. Indicia 54 are printed on the top surface 50 and the bottom surface 52. The indicia 54 comprise a name of color. The lid 48 corresponding to each bin 22 has unique name of a color with respect to each other.

A tab 56 is coupled to and extends upwardly from the top surface 50 of the lid 48. The tab 56 corresponding to each of the bins 22 has a unique geometric shape with respect to each other. Moreover, the tab 56 corresponding to each of the bins 22 has a unique color with respect to each other. The color of the tab 56 on each bin 22 corresponds to the name of the color printed on the corresponding lid 48. The geometric shapes may include a cube, a cuboid, a square based pyramid, a cone, a triangular prism, a triangular base pyramid, a cylinder and sphere.

A color wheel 58 is positioned on the upper side 26 of the second disk 24. The color wheel 58 is centrally positioned on the second disk 24. Thus, the ring defined by the bins 22 surrounds the color wheel 58. The color wheel 58 has a visible surface 60 and a plurality of color bars 62 are printed on the visible surface 60. Each of the color bars 62 has a color corresponding to the name of the color printed on the lid 48 corresponding to each bin 22. The color wheel 58 is positioned such that each of the color bars 62 is aligned with the corresponding name of the color on each bin 22.

A cover 64 is removably coupled to the storage array 18. The cover 64 has a topmost wall 66 and a perimeter wall 68 extending downwardly from the topmost wall 66. The perimeter wall 68 is continuous such that the cover 64 has a circular shape. The topmost wall 66 is comprised of a translucent material. Thus, the storage array 18 is visible when the cover 64 is positioned on the storage array 18. The perimeter wall 68 has a plurality of colors printed thereon. The plurality of colors on the perimeter wall 68 may include green, orange, purple, red, brown, blue, black and yellow.

The perimeter wall 68 has a distal edge 70 with respect to the topmost wall 66. The distal edge 70 frictionally engages the ledge 32 on the second disk 24 when the cover 64 is positioned on the storage array 18. The topmost wall 66 has a slot 72 extending therethrough. The slot 72 is centrally positioned on the topmost wall 66.

A pair of clips 74 is provided. Each of the clips 74 is coupled to the cover 64 and each of the clips 74 may be manipulated. Each of the clips 74 is positioned on the perimeter wall 68. Each of the clips 74 selectively engages the peripheral edge 30 of the second disk 24. Thus, the cover 64 is removably retained on the second disk 24. Each of the clips 74 may comprise a lever that is movably coupled to the cover 64 and a hook that is movably coupled to the handle. The hook may engage the second disk 24.

A handle 76 is removably coupled to the storage array 18 and the handle 76 may be manipulated thereby facilitating the storage array 18 to be carried. The handle 76 has a head 78 and a shaft 80 that is coupled to the head 78. The shaft 80 has a distal end 82 with respect to the head 78 and the shaft 80 is threaded adjacent to the distal end 82. The shaft 80 comprises a lower portion 84 that is slidably coupled to an upper portion 86. Thus, the shaft 80 has a telescopically adjustable length.

The handle 76 extends through the slot 86 when the cover 64 is positioned on the second disk 24. The shaft 80 extends through the second disk 24 and the distal end 82 of the shaft 80 threadably engages the first disk 12. Thus, the second disk 24 may be urged to rotate about the shaft 80. The head 78 is positioned in an extended position. Thus, the head 78 extends outwardly from the slot 86 thereby facilitating the head 78 to be gripped. The head 78 is positioned in a retracted position having the head 78 being recessed in the slot 86.

In use, the crayons are positioned in each of the bins 22. The crayons are arranged to correspond to the color of the tab 56 and the name of the color of the corresponding bin 22. The lid 48 corresponding to each of the bins 22 is closed and the cover 64 is positioned on the storage array 18. The clips 74 are manipulated to engage the second disk 24 to retain the cover 64 on the storage array 18. The handle 76 is extended through the slot 86 and the handle 76 threadably engages the first disk 12. The head 78 is positioned in the extended position to carry the storage array 18.

The cover 64 is removed and the lid 48 corresponding to each bin 22 is opened to access the crayons in the corresponding bin 22. The storage array 18 is employed in an educational environment such as an elementary school or the like. The storage array 18 facilitates the crayons to be organized and to be arranged by color. The storage array 18 is manipulated to spin on the first disk 12 thereby facilitating a user to remove crayons from selected bins 22. The user verbalizes the geometric shape of the tab 56 on each bin 22 when the user opens each bin 22. The color wheel 58, the name of the color printed on each bin 22 and the color of the tab 56 corresponding to each bin 22 facilitates learning colors of the crayons.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A storage assembly having a plurality of color coded bins, said assembly comprising:

a first disk being configured to be positioned on a support surface;

a storage array being configured to contain a plurality of objects, said storage array having a plurality of bins wherein each of said bins is configured to have the objects positioned therein, said storage array being rotatably positioned on said first disk;

a cover being removably coupled to said storage array; and a handle being removably coupled to said storage array wherein said handle is configured to be manipulated thereby facilitating said storage array to be carried, said handle having a head and a shaft being coupled to said head, said shaft having a distal end with respect to said head, said shaft being threaded adjacent to said distal end, said shaft comprising a lower portion being slidably coupled to an upper portion such that said shaft has a telescopically adjustable length.

2. The assembly according to claim 1, wherein:

said first disk having a top side; and said storage array comprises a second disk having an upper side, a lower side and a peripheral edge extending therebetween, said upper side being recessed along said peripheral edge to define a ledge on said second disk, said ledge having a bounding surface, said second disk being rotatably positioned on said first disk having said lower side abutting said top side.

3. The assembly according to claim 1, wherein each of said bins comprises a bottom wall and an exterior wall extending upwardly from said bottom wall, said exterior wall having a plurality of intersecting sides such that each of said bins has a trapezoidal shape, said plurality of intersecting sides including a first side being spaced from a second side, said exterior wall having a distal edge with respect to said bottom wall.

4. The assembly according to claim 3, wherein:

said storage array includes a second disk, said second disk having a ledge and an upper side, said ledge having a bounding surface; and said intersecting sides includes a first side being spaced from a second side, each of said bins being removably positioned on said second disk having said bottom wall abutting said upper side, said bins being arranged to define a ring extending around said second disk, said first side being aligned with said bounding surface of said ledge.

5. The assembly according to claim 4, further comprising a lid being hingedly coupled to said distal edge corresponding to said second side, said lid having a top surface and a bottom surface, each of said top surface and said bottom surface having indicia being printed thereon, said indicia comprising a name of a color, said top surface having a tab extending upwardly therefrom, said tab corresponding to each of said bins having a unique geometric shape with respect to each other.

6. The assembly according to claim 1, wherein:

said cover has a slot; and said handle extends through said slot when said cover is positioned on said second disk having said distal end of said shaft threadably engaging said first disk, said head being positioned in an extended position such that said head extends outwardly from said slot wherein said head is configured to be gripped, said head being positioned in a retracted position having said head being recessed in said slot.

7. The assembly of claim 1, further comprising:

said first disk having a top side;

said storage array comprising:

a second disk having an upper side, a lower side and a peripheral edge extending therebetween, said upper side being recessed along said peripheral edge to define a ledge on said second disk, said ledge having a bounding surface, said second disk being rotatably positioned on said first disk having said lower side abutting said top side, each of said bins comprising:

a bottom wall and an exterior wall extending upwardly from said bottom wall, said exterior wall having a plurality of intersecting sides such that each of said bins has a trapezoidal shape, said plurality of intersecting sides including a first side being spaced from a second side, said exterior wall having a distal edge with respect to said bottom wall, each of said bins being removably positioned on said second disk having said bottom wall abutting said upper side, said bins being arranged to define a ring extending around said second disk, said first side being aligned with said bounding surface of said ledge, a lid being hingedly coupled to said distal edge corresponding to said second side, said lid having a top surface, said top surface having indicia being printed thereon, said lid having a top surface and a bottom surface, each of said top surface and said bottom surface having indicia being printed thereon, said indicia comprising a name of a color, said top surface having a tab extending upwardly therefrom, said tab corresponding to each of said bins having a unique geometric shape with respect to each other, and a color wheel being positioned on said upper side of said second disk such that said ring defined by said bins surrounds said color wheel, said color wheel having a visible surface, said visible surface having a plurality of color bars being printed thereon, each of said color bars having a color corresponding to a color of said color strip of an associated one of said bins, said color wheel being positioned such that each of said color bars is aligned with said corresponding color strip;

said cover having a topmost wall and a perimeter wall extending downwardly from said topmost wall, said perimeter wall being continuous such that said cover has a circular shape, said perimeter wall having a distal edge with respect to said topmost wall, said distal edge frictionally engaging said ledge on said second disk when said cover is positioned on said storage array, said topmost wall having a slot extending therethrough, said slot being centrally positioned on said topmost wall;

a pair of clips, each of said clips being coupled to said cover wherein each of said clips is configured to be manipulated, each of said clips being positioned on said perimeter wall, each of said clips selectively engaging said peripheral edge of said second disk such that said cover is removably retained on said second disk; and said handle extending through said slot when said cover is positioned on said second disk having said distal end of said shaft threadably engaging said first disk, said head being positioned in an extended position such that said head extends outwardly from said slot wherein said head is configured to be gripped, said head being positioned in a retracted position having said head being recessed in said slot.

8. A storage assembly having a plurality of color coded bins, said assembly comprising:

a first disk being configured to be positioned on a support surface;

a storage array being configured to contain a plurality of objects, said storage array having a plurality of bins wherein each of said bins is configured to have the objects positioned therein, said storage array being rotatably positioned on said first disk;

a cover being removably coupled to said storage array;

a handle being removably coupled to said storage array wherein said handle is configured to be manipulated thereby facilitating said storage array to be carried;

each of said bins having a color strip;

a second disk having an upper side; and a color wheel being positioned on said upper side of said second disk such that a ring defined by said bins surrounds said color wheel, said color wheel having a visible surface, said visible surface having a plurality of color bars being printed thereon, each of said color bars having a color corresponding to a color of said color strip of an associated one of said bins, said color wheel being positioned such that each of said color bars is aligned with said corresponding color strip.

9. A storage assembly having a plurality of color coded bins, said assembly comprising:

a first disk being configured to be positioned on a support surface;

a storage array being configured to contain a plurality of objects, said storage array having a plurality of bins wherein each of said bins is configured to have the objects positioned therein, said storage array being rotatably positioned on said first disk;

a cover being removably coupled to said storage array;

a handle being removably coupled to said storage array wherein said handle is configured to be manipulated thereby facilitating said storage array to be carried;

a second disk having a ledge; and said cover having a topmost wall and a perimeter wall extending downwardly from said topmost wall, said perimeter wall being continuous such that said cover has a circular shape, said perimeter wall having a distal edge with respect to said topmost wall, said distal edge frictionally engaging said ledge on said second disk when said cover is positioned on said storage array, said topmost wall having a slot extending therethrough, said slot being centrally positioned on said topmost wall.

10. The assembly according to claim 9, further comprising a pair of clips, each of said clips being coupled to said cover wherein each of said clips is configured to be manipulated, each of said clips being positioned on said perimeter wall, each of said clips selectively engaging a peripheral edge of said second disk such that said cover is removably retained on said second disk.

* * * * *